US006988501B2

(12) United States Patent
Favaro

(10) Patent No.: US 6,988,501 B2
(45) Date of Patent: Jan. 24, 2006

(54) TOBACCO PROCESSING MACHINE

(75) Inventor: Mansueto Favaro, Treviso (IT)

(73) Assignee: Garbuio S.p.A., Treviso (IT)

( * ) Notice: Subject to any disclaimer, the term of this patent is extended or adjusted under 35 U.S.C. 154(b) by 179 days.

(21) Appl. No.: 10/178,704

(22) Filed: Jun. 25, 2002

(65) Prior Publication Data

US 2003/0000537 A1 Jan. 2, 2003

(30) Foreign Application Priority Data

Jul. 2, 2001 (IT) ..... TV2001A0086

(51) Int. Cl.
*A24B 3/02* (2006.01)

(52) U.S. Cl. ..... 131/300; 131/304; 131/305

(58) Field of Classification Search ..... 131/291, 131/300, 302, 303–305; 34/467, 498, 499, 34/501, 503, 504
See application file for complete search history.

(56) References Cited

U.S. PATENT DOCUMENTS

| | | | | | |
|---|---|---|---|---|---|
| 436,032 | A * | 9/1890 | Coffee | 131/108 |
| 541,283 | A * | 6/1895 | Kester | 131/305 |
| 556,989 | A * | 3/1896 | Kester | 131/305 |
| 3,906,961 | A * | 9/1975 | Rowell et al. | 131/303 |
| 4,054,145 | A | 10/1977 | Berndt et al. | |
| 4,757,830 | A * | 7/1988 | Halliday | 131/302 |
| 4,935,424 | A * | 6/1990 | Caprathe et al. | 514/253.1 |
| 4,977,907 | A * | 12/1990 | Ray et al. | 131/290 |
| 5,425,384 | A * | 6/1995 | White | 131/305 |
| 5,676,164 | A * | 10/1997 | Martin | 131/305 |
| 6,155,269 | A * | 12/2000 | Franke et al. | 131/303 |
| 6,158,441 | A * | 12/2000 | Grigutsch et al. | 131/296 |
| 6,286,515 | B1 * | 9/2001 | Wagoner | 131/305 |
| 2002/0033182 | A1 * | 3/2002 | Ehling et al. | 131/300 |

FOREIGN PATENT DOCUMENTS

| | | |
|---|---|---|
| FR | 2 073 745 | 10/1971 |
| GB | 2 142 519 | 1/1985 |
| WO | 93 22064 | 11/1993 |

* cited by examiner

*Primary Examiner*—Steven P. Griffin
*Assistant Examiner*—Carlos Lopez
(74) *Attorney, Agent, or Firm*—Albert Josif; Daniel O'Byrne

(57) ABSTRACT

A tobacco processing machine, comprising a frame that is cylindrical and hollow and has an inclined axis; the frame rotates axially so as to break up tobacco bales or slices and is internally provided with rods for moving the tobacco that protrude radially; the tobacco processing machine further comprising elements for feeding steam and/or water and/or another fluid, which are provided on the inner lateral surface of the frame.

17 Claims, 3 Drawing Sheets

TOBACCO PROCESSING MACHINE

BACKGROUND OF THE INVENTION

The present invention relates to a machine for processing tobacco bales or slices.

Currently, in lines for processing tobacco at the manufacturing level, raw tobacco bales are broken up by means of a process that is commonly known as slicing and direct conditioning process.

The tobacco bales, once freed from their packaging, depending on their dimensions may be subjected to slicing, so as to reduce them to dimensions that are compatible with the machines designed to process them.

The tobacco slices or intact bales are then conveyed to a known type of machine, designated by the reference numeral 1 in FIGS. 1 and 2, which is conveniently constituted by a frame 2 that is shaped like a cylinder or a rotating drum.

This known type of machine 1 for processing tobacco bales or slices must break them up, heat the resulting intermediate product, designated by the reference numeral 3, to the intended temperature, maintain its temperature for a preset time, known as transit time, and finally humidify the intermediate product until a preset level of humidity is reached.

The cylindrical frame 2 rotates about its own axis, which is conveniently inclined downward so as to allow the simultaneous advancement of the tobacco inside the cylinder.

The tobacco is moved by means of a plurality of radial rods, designated by the reference numeral 4, which protrude inside the cylinder and are suitable to lift the intermediate product 3.

The product, once it has reached a position that is proximate to the upper end of the cylinder, falls back, forming a downward stream 5, which by way of the inclination of the axis falls in a more advanced position along the axis of the cylinder.

In these conventional machines 1 there are provided, at one or both ends of the cylindrical frame 2, one or more nozzles, designated by the reference numeral 6, which are adapted to introduce steam or atomize water by means of steam or compressed air (using therefore two paired nozzles) so as to both humidify and heat the intermediate product 3.

The nozzles 6 are advantageously constituted by double water/steam or water/compressed air nozzles, in which the gaseous element is designed to atomize the water.

Moreover, the machine 1 is advantageously provided with an external duct 7, which comprises a fan 8 and is adapted to generate a current of air that flows, inside the cylinder, in equicurrent or countercurrent with respect to the flow of tobacco, so as to render the humidification and/or heating of the intermediate product 3 as uniform as possible.

In these conventional machines 1, the transit speed and therefore the retention time of the tobacco are determined first of all by the degree of inclination of the drum-like or cylindrical frame 3 and by the speed at which the air and the steam or water are introduced at the ends of the cylinder.

Depending on all of the above variables, a curve is generated which characterizes the behavior of the temperature in the environment inside the cylinder.

For optimum treatment of the tobacco, this temperature should have a behavior that has a peak at the input end, a subsequent constant behavior up to 80–85% of the length of the cylinder, and finally a decrease in the temperature in the output region, where an injection of conditioning water is usually provided.

The main drawback of these conventional tobacco processing machines 1 is that the direct conditioning systems with which they are equipped, described briefly above, often perform a scarcely effective humidification and/or heating of the intermediate product 3.

In particular, it is very difficult to control the behavior of the temperature curve along the axis of the cylinder: the injection of the steam, which it the primary cause of the heating of the tobacco, causes only at the ends of the drum-like frame a heating that is characterized by two temperature peaks located at the input and output of the cylinder and by a central trough that covers most of the length of said cylinder.

The current of optionally preheated air, which should convey steam and water along the entire extension of the cylinder, is in practice scarcely effective in equalizing the temperature behavior.

Moreover, it worsens the drawback constituted by the difficulties in controlling the transit time of the tobacco inside the machine, since it acts differently depending on the characteristics of the tobacco being treated.

In particular, the transit time can be altered by the air stream due to the different density of the tobacco, since there is a greater or smaller propulsion effect (in the case of an equicurrent air stream) or a greater or smaller slowing or retention effect (in the case of a countercurrent air stream) depending on the greater or lower lightness of the tobacco.

Another drawback consists in that the weight and consistency of the tobacco in transit cause a variation in the transit speed also as a function of the number and arrangement of the nozzles 6 for the injection of the steam and water from the ends of the frame.

More specifically, injection at the loading end tends to increase the advancement speed of the intermediate product, while injection at the unloading end tends to retain the tobacco inside the cylinder.

Some conventional machines 1 can be equipped with mechanical means adapted to adjust the transit speed according to the quality and characteristics of the tobacco; however, such mechanical means are highly ineffective, since they assume a control of the rotation rate or inclination of the cylinder.

Actually, the inclination of the axis is usually fixed, and even if it were made variable it could not be adjusted continuously and at the same time effectively in order to cope with the sometimes rapid behavior variations that depend on the quality of the product being treated.

Moreover, the range available for varying the speed of the cylinder is very limited, since in order to properly form the falling stream 5 the product must fall from a rather narrow region of the upper end of the cylinder, designated by the angle $\alpha$ in FIG. 2.

As a partial remedy to the above-described drawbacks, machines for treating tobacco are known which are designated by the reference numeral 11 in FIGS. 3 and 4 and have a device 12 for injecting steam and water that is advantageously constituted by one or more tubes 13 arranged inside the cylindrical frame, designated by the reference numeral 14.

The tubes 13 are supported at their free ends and have, along part or all of their length, suitable nozzles 15 for injecting steam, so as to achieve an injection direction that is approximately perpendicular to the advancement direction of the intermediate product, designated by the reference numeral 16 in the figures.

In this manner, the influence of the steam injection on the transit speed is reduced and at the same time the use of an air current for entrainment along the axis of the cylinder is rendered substantially unnecessary.

The tubes 13 are usually arranged in the opposite position with respect to the product fall region, designated by the reference numeral 17 in FIGS. 3 and 4.

One drawback of conventional machine 11 is the fact that it is often difficult to insert one or more tubes 13, which are necessary of the self-supporting type, along the entire length of the frame 14, which can in some cases exceed ten meters.

Another important drawback is that the radial rods, generally designated by the reference numeral 18, which protrude inside the cylinder and are designed to move and lift the intermediate product 16, force to place the tubes 13 so that they are far from the internal surface of the cylinder, in order to avoid interference with the rods 18.

Due to the length of the rods 18, therefore, the tube 13 cannot be placed in the position that is most convenient to allow optimum steam injection.

Another severe problem can be due to the continuous impact between the tobacco slices or bales and the tubes 13, which can lead to an excessive mechanical stress of said tubes and therefore to consequent malfunctions or breakdowns of said machine 11.

A further drawback of the conventional machines 11 is that leaves or strips of tobacco, designated by the reference numeral 19 in FIG. 4, can straddle said one or more tubes 13 and remain there until they are removed by chance by additional incoming intermediate product 16 or until the machine is cleaned at the end of the production cycle.

In the first case, the tobacco retained by the tube 13 is humidified excessively, and its return to the main stream of intermediate product 16 generates a critical quality problem.

In the second case, instead, a possibly considerable quantity of intermediate product is wasted.

There are known mechanical means for limiting the straddling of the leaves or for cleaning the tube 13 continuously, such as for example periodic or continuous rotation of the tube, the arrangement of rotating cleaning brushes, usually located above the tube, or the arrangement of curved tile-shaped protections above the tube.

However, all these mechanical means are very complicated and scarcely effective and require considerable maintenance.

SUMMARY OF THE INVENTION

The aim of the present invention is to solve the above-described drawbacks by providing a tobacco processing machine that allows optimum treatment of the tobacco regardless of its density or lightness.

Within this aim, an object of the present invention is to provide a tobacco processing machine that allows to perform optimum humidification and/or effective heating of the intermediate product uniformly along the entire length of the cylindrical frame.

Another object is to provide a tobacco processing machine that does not require an air stream along the cylinder.

Another important advantage is the possibility to differentiate the amount of steam or water injected in the different parts of the length of the cylinder, so as to control the shape of the temperature curve and divide the cylinder into a plurality of regions.

A further object is to provide an optimum injection of the steam along the falling stream of tobacco, with a consequent substantial improvement of the efficiency of the machine.

A further object is to simplify and speed up the cleaning process at the end of the production cycle.

A further object is to provide a tobacco processing machine that is structurally simple and reliable and has low manufacturing costs.

This aim and these and other objects that will become better apparent hereinafter are achieved by a tobacco processing machine, which comprises a frame that is cylindrical and hollow, has an inclined axis, and rotates axially, for breaking up tobacco bales or slices, inside which means for moving said tobacco are provided which are constituted by a plurality of rods, characterized in that it comprises means for feeding steam and/or water and/or another fluid, said means being provided on an inner lateral surface of said cylinder and rotating with it.

BRIEF DESCRIPTION OF THE DRAWINGS

Further characteristics and advantages of the present invention will become better apparent from the following detailed description of a particular embodiment thereof, illustrated only by way of non-limitative example in the accompanying drawings, wherein.

DESCRIPTION OF THE PREFERRED EMBODIMENTS

Figure 1:
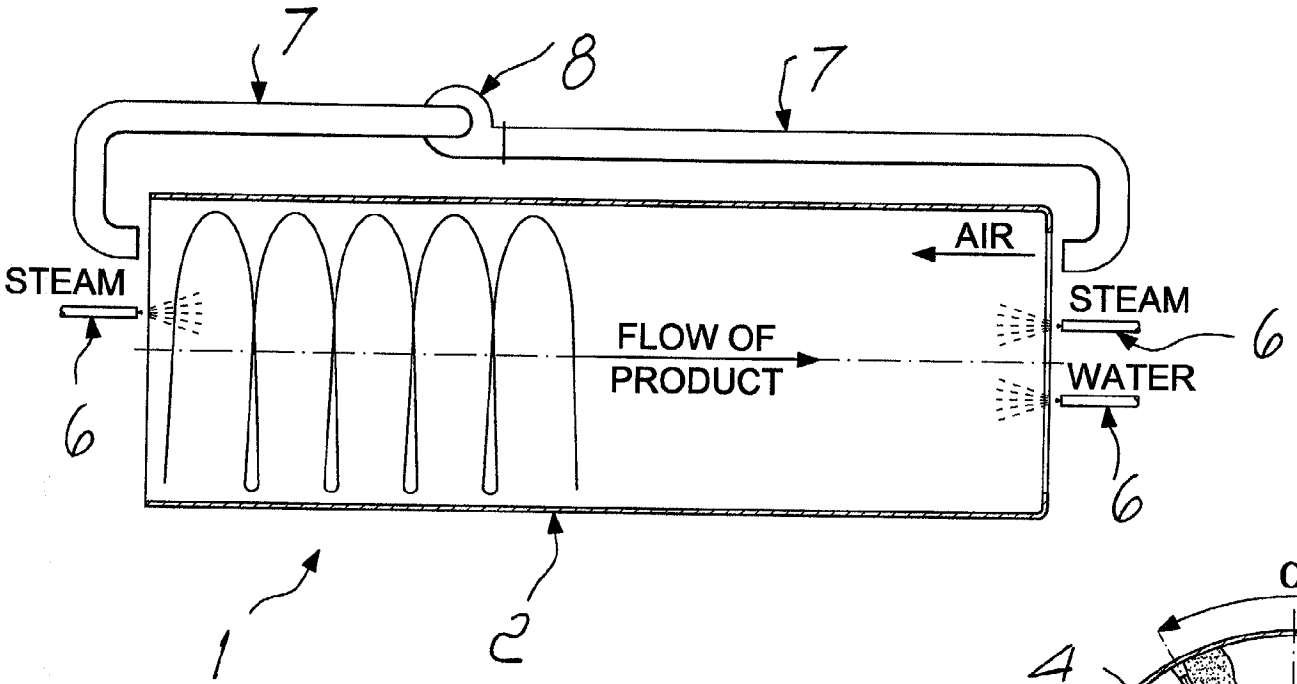
Fig. 1 PRIOR ART
FIGS. 1 and 2 are respectively a side view and a front view of a first conventional tobacco processing machine.
Figure 2:
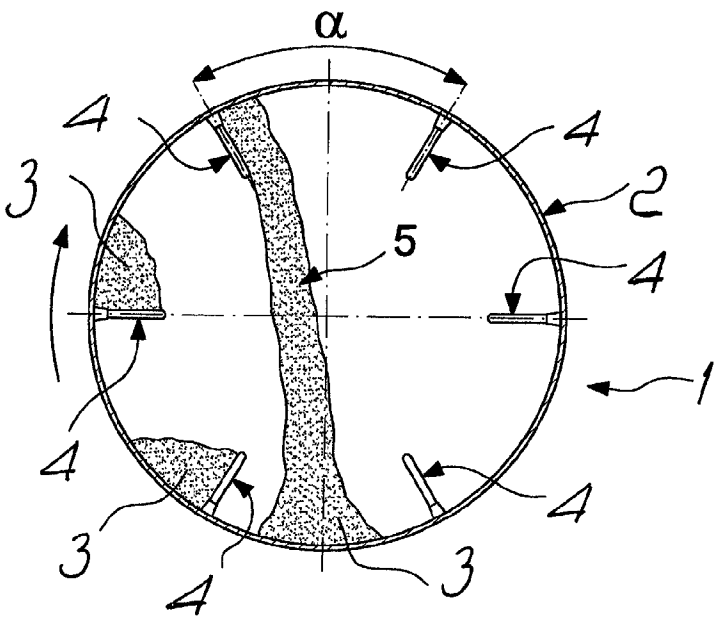
Fig. 2 PRIOR ART
Figure 3:
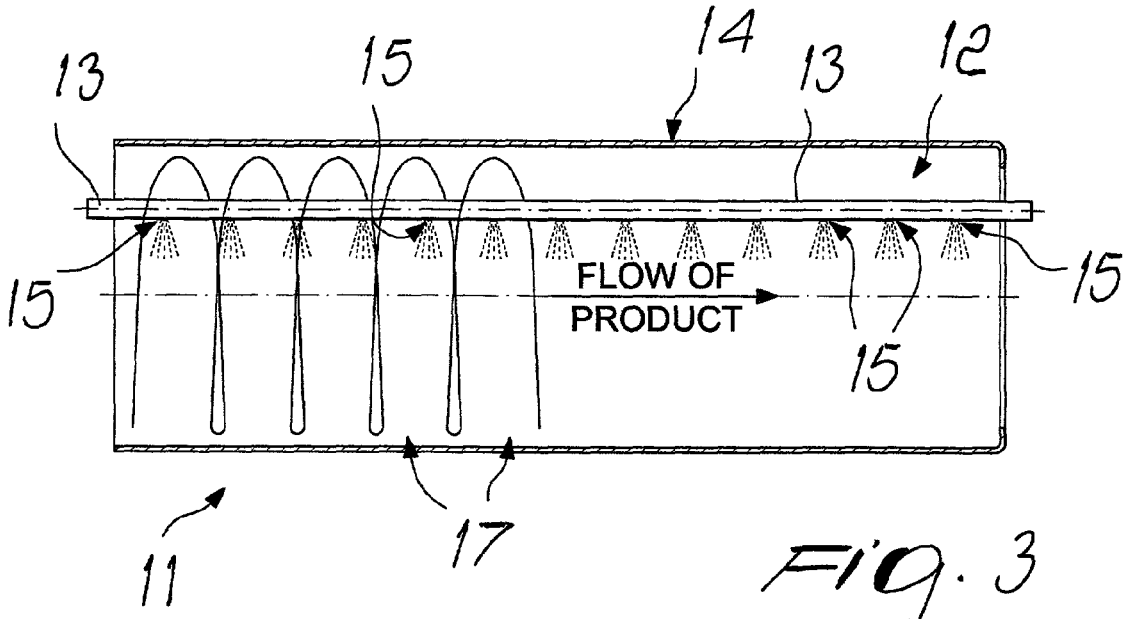
Fig. 3 PRIOR ART
FIGS. 3 and 4 are respectively a side view and a front view of a second conventional tobacco processing machine.
Figure 4:
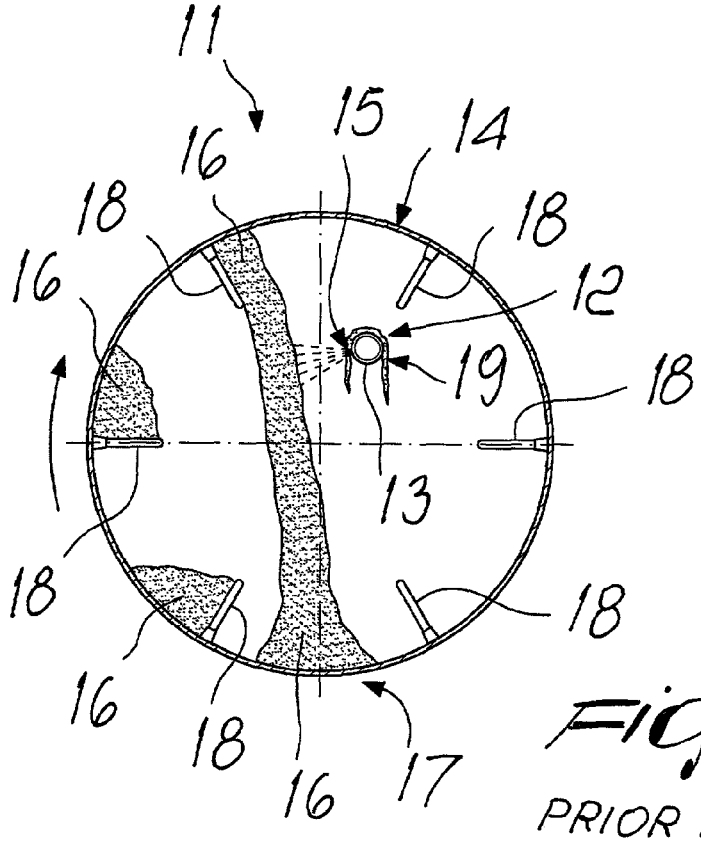
Fig. 4 PRIOR ART

With reference to the figures, the reference numeral 51 designates a machine for processing tobacco bales or slices, advantageously constituted by a frame 52, which is advantageously cylindrical, conveniently hollow and arranged so that its axis is slightly inclined.

Figure 6:
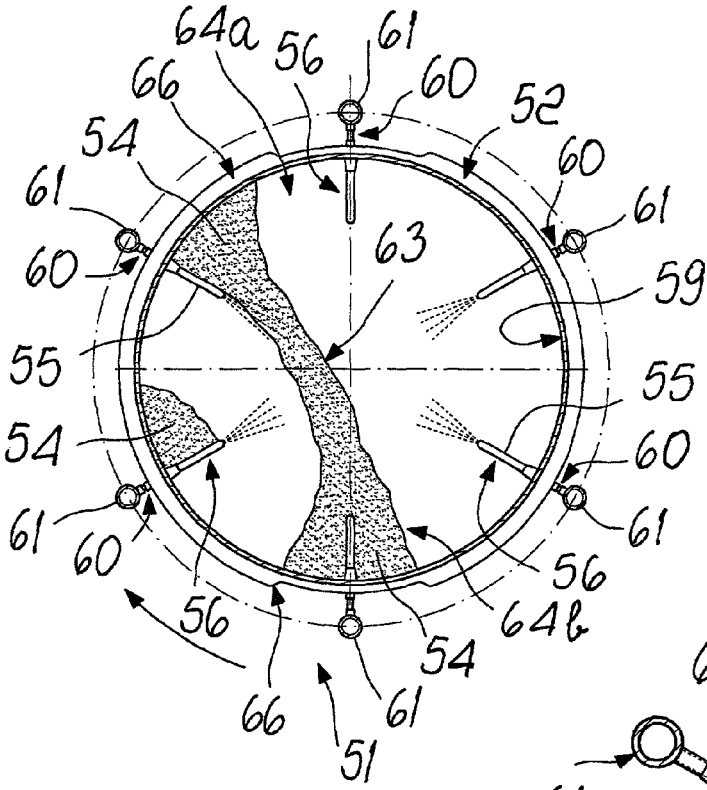

The frame 52 has, at its free ends, a tobacco input region 53*a* and an output region 53*b* for a intermediate product, which is designated by the reference numeral 54 in FIG. 6; in particular, the frame 52 is inclined so that the output region 53*b* is located at a lower level than the input region 53*a*.

The frame 52 rotates about its own axis so as to allow the intermediate product 54 to move toward the output region 53*b*.

During its rotation, the frame 52 also breaks up the tobacco bales or slices, advantageously through suitable movement means, which in this particular embodiment are constituted by multiple rods 55 that protrude radially inside the frame 52.

The machine 51 further comprises humidification and/or heating means, which are advantageously obtained by way of steam feeder means, designated by the reference numeral 56, which are preferably formed at the rods 55.

Figure 7:
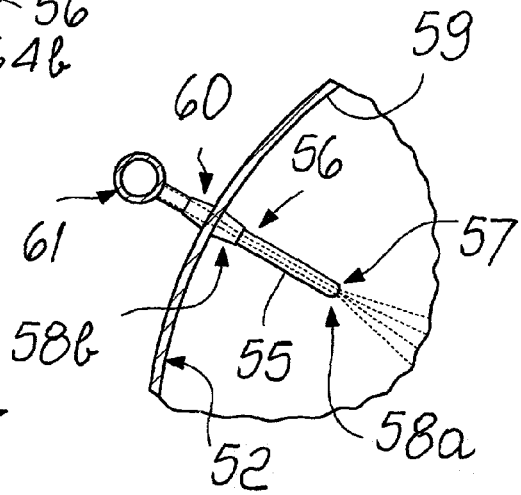
FIG. 7 is a front view of a detail of FIG. 6.

The rods 55 are in fact conveniently perforated axially, so as to obtain respective nozzles, one of which is designated by the reference numeral 57 in FIG. 7.

At the first free end, designated by the reference numeral 58*a*, of each rod 55 it is possible to use individual or double nozzles, depending on the type of fluid to be injected into the intermediate product 54.

At a second free end 58*b*, which lies opposite the first one, the rods 55 are associated with, or rigidly coupled to, the internal surface 59 of the frame 52 at respective holes, not shown, for connection to a duct 60 and a tube 61.

Figure 5:
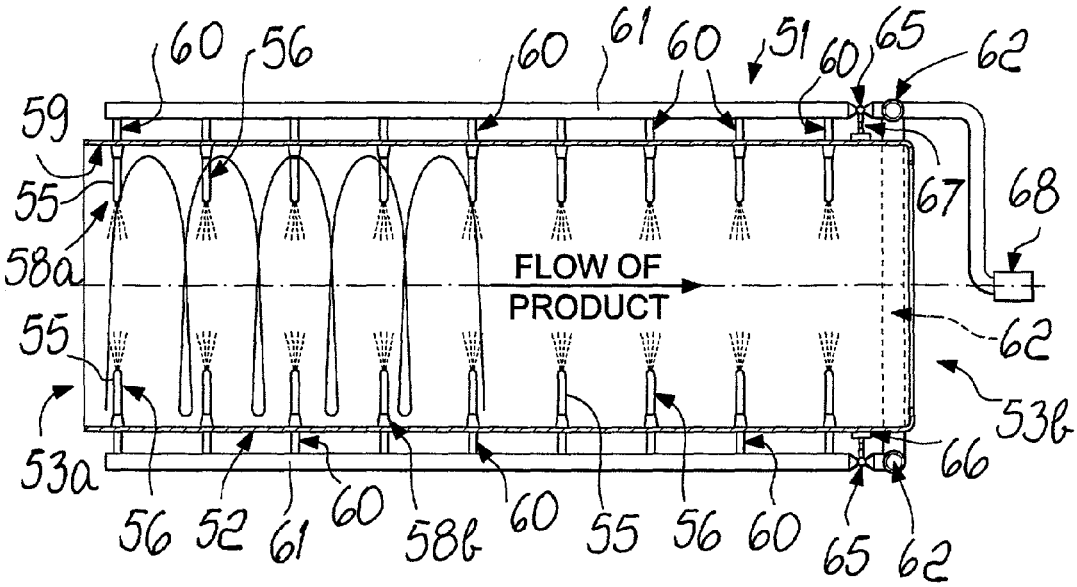
FIGS. 5 and 6 are respectively a side view and a front view of tobacco processing machine according to the present invention.

In the embodiment illustrated by way of example in FIGS. 5 to 7, the machine 51 has six tubes 61, which are arranged longitudinally around the outer surface of the frame 52 in mutually equidistant positions.

Such tubes are advantageously fed by means of a single manifold, designated by the reference numeral 62, which is arranged annularly with respect to the frame 52, for example proximate to the output region 53*b*.

The machine 51 can advantageously comprise means for temporarily and selectively deactivating the steam feeder means 56, so as to allow to inject the steam predominantly from the nozzles 57 arranged in an approximately lateral position, thus avoiding injection in alignment with the direction of the falling stream of tobacco, designated by the reference numeral 63.

To prevent the alteration of the falling motion that this would entail, it is therefore convenient to prevent the injection of steam into the falling stream 63 by the feeder means 56 that are arranged proximate to the tobacco release region, designated by the reference numeral 64, and optionally also of the feeder means that are arranged in the diametrically opposite position, termed fall region 64*b*.

One embodiment of the means for temporarily and selectively deactivating the steam feeder means 56 consists in providing, along the tubes 61, flow control valves, designated by the reference numeral 65 in FIG. 5, which can be activated conveniently by way of means adapted to temporarily interrupt the outflow of steam, such as for example a mechanical cam-based actuation system.

In particular, at valves 65, externally to the frame 52, an annular cam 66 is provided, which is rotatably associated perimetrically with the frame 52 and has a radially arranged raised portion.

The annular cam 66, by acting on a roller, designated by the reference numeral 67, that is mounted on the moving part of the valve 65, causes the closure of such valves at the release region 64*a* and at the fall region 64*b*, or in any case in the regions where the injection of steam is not required.

The tubes 61 for feeding water or steam can be connected to the nozzles 57 according to schemes that are different from the one described above, depending on the most convenient functional model.

The feeding of the tubes 61, during the rotation of the machine 51, is ensured by a rotary connector, designated by the reference numeral 68, which is preferably arranged along the rotation axis of the frame 52, for example proximate to the output region 53*b*.

The arrangement of the rods 55 can be the most appropriate according to requirements; such arrangement can provide, for example, for an alignment thereof along multiple straight lines or along helical generatrices.

In the particular illustrated arrangement, a particularly simple feeding system for the feeder means 56 has been chosen in which each row of rods 55 is fed by a single tube 61 arranged outside the frame 52.

Operation is therefore as follows: as shown in FIGS. 5 to 7, the tobacco bales and slices, conveniently shredded into leaves and strips of intermediate product 54, are lifted by the rods 55 up to the fall region 64*b*.

During the fall, the falling stream of tobacco 63 forms and is struck by the steam or optionally by the water that exits from the feeder means 56.

Such spraying occurs predominantly on the two sides of the falling stream 63, not from above or below, thanks to the presence of the deactivation means, which are constituted by the annular cam 66 and by the valves 65 in the illustrated embodiment.

It has thus been observed that the present invention has achieved the intended aim and objects, a tobacco processing machine having been devised which allows to provide optimum humidification and/or effective heating of the intermediate product uniformly along the entire length of the cylindrical frame, independently of the density or lightness of said intermediate product.

The invention further allows to differentiate the amount of steam or water injected in the different parts of the length of the cylinder, so as to allow to control the shape of the temperature curve and divide the cylinder into a plurality of regions.

This differentiation can be achieved easily by means of a chosen connection of the rods to the feeder tubes, or in another manner by adapting the dimensions of the injection nozzles to specific requirements.

The injection of the steam along the falling stream of tobacco further occurs on both sides thereof, with a consequent great improvement in the efficiency of the machine and in the quality and uniformity of the output intermediate product.

Finally, the cleaning steps at the end of the production cycle are more simple and rapid, since it is possible to use the rods to inject the cleaning water.

The invention is of course susceptible of numerous modifications and variations, all of which are within the scope of the appended claims.

Thus, for example, it is possible to feed the steam feeder means by way of tubes 61 formed monolithically with the wall of the frame 52, by means of conventional construction technologies, such as so-called double-skin cylinders.

It is also possible to provide for an arrangement of said rods in which said rods are more densely packed at one or more preset regions or to provided, even more advantageously, for a different distribution of the flow-rate of steam or water emitted by said rods, so as to perform a chosen treatment for said tobacco.

The materials employed, as well as the dimensions that constitute the individual components of the present invention, may of course be the more pertinent according to specific requirements.

The disclosures in Italian Patent Application No. TV2001A000086 from which this application claims priority are incorporated herein by reference.

What is claimed is:

1. A tobacco processing machine, comprising a frame that is cylindrical and hollow, has an inclined axis, and rotates axially, for breaking up tobacco bales or slices, inside which a plurality of rods are provided which protude approximately radially from the inner lateral surface of said frame and rotating with said frame for moving said tobacco, said rods being axially perforated and being associated with water and/or steam distribution ducts and forming nozzles at free ends thereof directed towards said axis of said frame and arranged distal from said axis of said frame for feeding steam and/or water and/or another fluid in a direction towards said axis of said frame.

2. The machine according to claim 1, wherein said frame has, at its free ends, an input region for said tobacco bales or slices and an output region for an intermediate product, said output region being arranged at a lower level than the input region.

3. A tobacco processing machine, comprising a frame that is cylindrical and hollow, has an inclined axis, and rotates axially, for breaking up tobacco bales or slices, inside which means for moving said tobacco are provided which are constituted by a plurality of rods, further comprising means for feeding steam and/or water and/or another fluid, said feeding means being provided on an inner lateral surface of said frame and rotating with it, further comprising means for temporarily and selectively deactivating said feeding means, which are actuated by the rotation of said frame.

4. The machine according to claim 3, wherein said plurality of rods is axially perforated, so as to obtain, at a first free end that is directed inward, respective individual or double nozzles for feeding an atomization gas.

5. The machine according to claim 4, wherein at a second free end, which lies opposite the first one, each one of said rods is associated with, or rigidly coupled to, the inner lateral surface of said frame at a respective hole for connection to a duct.

6. The machine according to claim 5, wherein said ducts are affected by one or more tubes for feeding water and/or steam, which in turn are connected to at least one manifold for connection to a rotary connector.

7. The machine according to claim 6, wherein said one or more tubes are arranged longitudinally proximate to the outer lateral surface of said frame.

8. The machine according to claim 7, wherein said one or more tubes are fed by means of a single manifold, which is arranged annularly with respect to said frame approximately proximate to said output region of said intermediate product.

9. The machine according to claim 8, wherein the feeding of said one or more tubes, during the rotation of said machine, is ensured by said rotary connector, which is arranged along the rotation axis of said frame, proximate to said output region.

10. The machine according to claim 3, wherein said means for temporarily and selectively deactivating said steam feeding means allow to inject steam predominantly approximately laterally along said lateral surface of said frame, so as to avoid the injection of steam approximately parallel to the fall direction of said intermediate product.

11. The machine according to claim 3, wherein said means for temporarily and selectively deactivating said steam feeding means are suitable to deactivate a steam feed that during the rotation of said frame is arranged proximate to the release region and/or proximate to the diametrically opposite region where said intermediate product falls.

12. The machine according to claim 7, wherein said means for temporarily and selectively deactivating said steam feeding means are constituted by one or more valves for controlling the flow of said one or more tubes, which is activated by means of a mechanical cam-based actuation system.

13. The machine according to claim 12, wherein an annular cam is arranged externally to said frame, at said one or more valves, and is rotatably associated perimetrically with respect said frame.

14. The machine according to claim 13, wherein said annular cam has a radial raised portion so as to act, in its relative rotation around said frame, on an activation device that protrudes externally from said one or more valves, causing the closure thereof at release or fall regions of the tobacco.

15. The machine according to claim 1, wherein said rods are arranged in alignment along multiple parallel straight rows.

16. The machine according to claim 1, wherein said rods are arranged in alignment along helical generatrices.

17. The machine according to claim 6, wherein said one or more tubes are formed monolithically with the wall of said frame.

* * * * *